US007937907B2

(12) United States Patent
Fleckenstein et al.

(10) Patent No.: US 7,937,907 B2
(45) Date of Patent: May 10, 2011

(54) CONTAINER FILLING AND LOCKING DEVICE

(75) Inventors: Tim Fleckenstein, Vellberg (DE); Klaus Blumenstock, Satteldorf (DE)

(73) Assignee: Robert Bosch GmbH, Stuttgart (DE)

( * ) Notice: Subject to any disclaimer, the term of this patent is extended or adjusted under 35 U.S.C. 154(b) by 1 day.

(21) Appl. No.: 11/912,032

(22) PCT Filed: May 10, 2006

(86) PCT No.: PCT/EP2006/062185

§ 371 (c)(1),
(2), (4) Date: Oct. 19, 2007

(87) PCT Pub. No.: WO2006/131433

PCT Pub. Date: Dec. 14, 2006

(65) Prior Publication Data

US 2008/0184671 A1 Aug. 7, 2008

(30) Foreign Application Priority Data

Jun. 10, 2005 (DE) ..... 10 2005 026 986

(51) Int. Cl.
*B65B 39/12* (2006.01)

(52) U.S. Cl. ..... 53/268; 53/273; 53/287

(58) Field of Classification Search ..... 53/281, 53/283, 267, 268, 284.6, 247, 273, 249, 250, 53/266.1, 287

See application file for complete search history.

(56) References Cited

U.S. PATENT DOCUMENTS

| | | | | |
|---|---|---|---|---|
| 3,837,378 | A * | 9/1974 | Kanki et al. | 141/146 |
| 3,939,626 | A | 2/1976 | Cioni et al. | |
| 4,096,683 | A | 6/1978 | McMickle, Jr. | |
| 4,918,907 | A * | 4/1990 | Roach et al. | 53/453 |
| 5,385,004 | A * | 1/1995 | Tolson | 53/548 |
| 5,692,362 | A * | 12/1997 | Hoyland | 53/473 |
| 5,753,067 | A * | 5/1998 | Fukuda et al. | 156/358 |
| 5,842,321 | A * | 12/1998 | Jones | 53/281 |
| 5,934,859 | A | 8/1999 | Goetzelmann | |
| 5,971,041 | A | 10/1999 | Drewitz | |
| 6,189,578 | B1 * | 2/2001 | Clusserath | 141/7 |
| 6,199,350 | B1 * | 3/2001 | Brechel et al. | 53/510 |
| 7,065,936 | B2 * | 6/2006 | Lindee et al. | 53/251 |
| 2004/0079051 | A1 | 4/2004 | Lippman et al. | |

FOREIGN PATENT DOCUMENTS

| | | | |
|---|---|---|---|
| DE | 40 19 516 | A1 | 1/1991 |
| DE | 196 04 100 | A1 | 8/1997 |
| DE | 197 16 846 | C1 | 11/1998 |
| DE | 19716846 | C1 | 11/1998 |

(Continued)

OTHER PUBLICATIONS

Bausch+Stroebel SFM 202, "Filling and Closing Machine for Disposable Syringes", Ilshofen, Germany.

*Primary Examiner* — Thanh K Truong
(74) *Attorney, Agent, or Firm* — Ronald E. Greigg

(57) ABSTRACT

The invention relates to a device for filling and sealing containers, including a filling device for filling at least one container, a sealing device for sealing at least one container and a transport device for conveying at least one fillable container to the filling and locking devices and displacement means for modifying a distance between the filling and locking devices in a transport direction.

13 Claims, 5 Drawing Sheets

FOREIGN PATENT DOCUMENTS

| | | | |
|---|---|---|---|
| DE | 102 46 061 | A1 | 4/2004 |
| DE | 103 22 556 | A1 | 4/2004 |
| DE | 10246061 | A1 | 4/2004 |
| DE | 103 30 700 | A1 | 1/2005 |
| JP | 61-297041 | | 12/1986 |
| JP | 3-162207 | | 7/1991 |
| WO | WO 00/64749 | A1 | 11/2000 |
| WO | 2004060474 | A1 | 7/2004 |

* cited by examiner

CONTAINER FILLING AND LOCKING DEVICE

CROSS-REFERENCE TO RELATED APPLICATION

This application is a 35 USC 371 application of PCT/EP 2006/062185 filed on May 10, 2006.

BACKGROUND OF THE INVENTION

1. Field of the Invention

The present invention relates to an improved container filling and sealing device.

2. Description of the Prior Art

DE-A-103 30 700 discloses a package filling and sealing machine which includes several processing stations. The processing stations are each equipped with a robot; the robots of each processing station have structurally identical robot mechanics. A processing station for the filling process operates independently of a processing station that attaches a seal to a still-open end of a syringe.

SUMMARY AND ADVANTAGES OF THE INVENTION

The container filling and sealing device according to the invention has the advantage over the prior art that an immediate sealing can occur after the filling. Since the filled syringes remain open for only a very short span of time, this reduces the probability of contamination. It is also possible to increase the output by changing the distance between the filling devices and the sealing devices in the transport direction of the containers to be filled.

In a suitable modification, a three-axis robot is used as the moving mechanism to move the filling device. Such robots are sufficiently known and have fast operating speeds, This makes it possible to further increase the output of the container filling and sealing device.

In a suitable modification, the transport device is operated in a synchronized fashion. Particularly for a synchronously operated transport device, the possibility of a variable distance between the filling device and sealing device represents a further optimization with regard to a short dwell time of the filled containers and with regard to output capacity. In addition, the device can be adapted to different processing steps in that the distance between the filling device and the sealing device is selected to be large enough to permit the filled containers to be withdrawn for the purpose of in-process controls after the filling.

In a suitable modification, the moving mechanism is triggered as a function of the speed of the transport device. Thus, the containers can be filled and/or sealed during the ongoing transport.

In a suitable modification, only the filling device can be moved in the transport direction, whereas the sealing device assumes a fixed position in relation to the transport device and can only be moved in the vertical direction for the sealing. This selected constellation does permit further optimization of the costs of the device, but increases the time between filling and sealing since an empty row lies between them.

Advantageous modifications of the container filling and sealing device according to the invention are disclosed.

BRIEF DESCRIPTION OF THE DRAWINGS

Two exemplary embodiments of the invention are explained in greater detail below, with reference to the drawings, in which.

DESCRIPTION OF THE PREFERRED EMBODIMENTS

Figure 1:
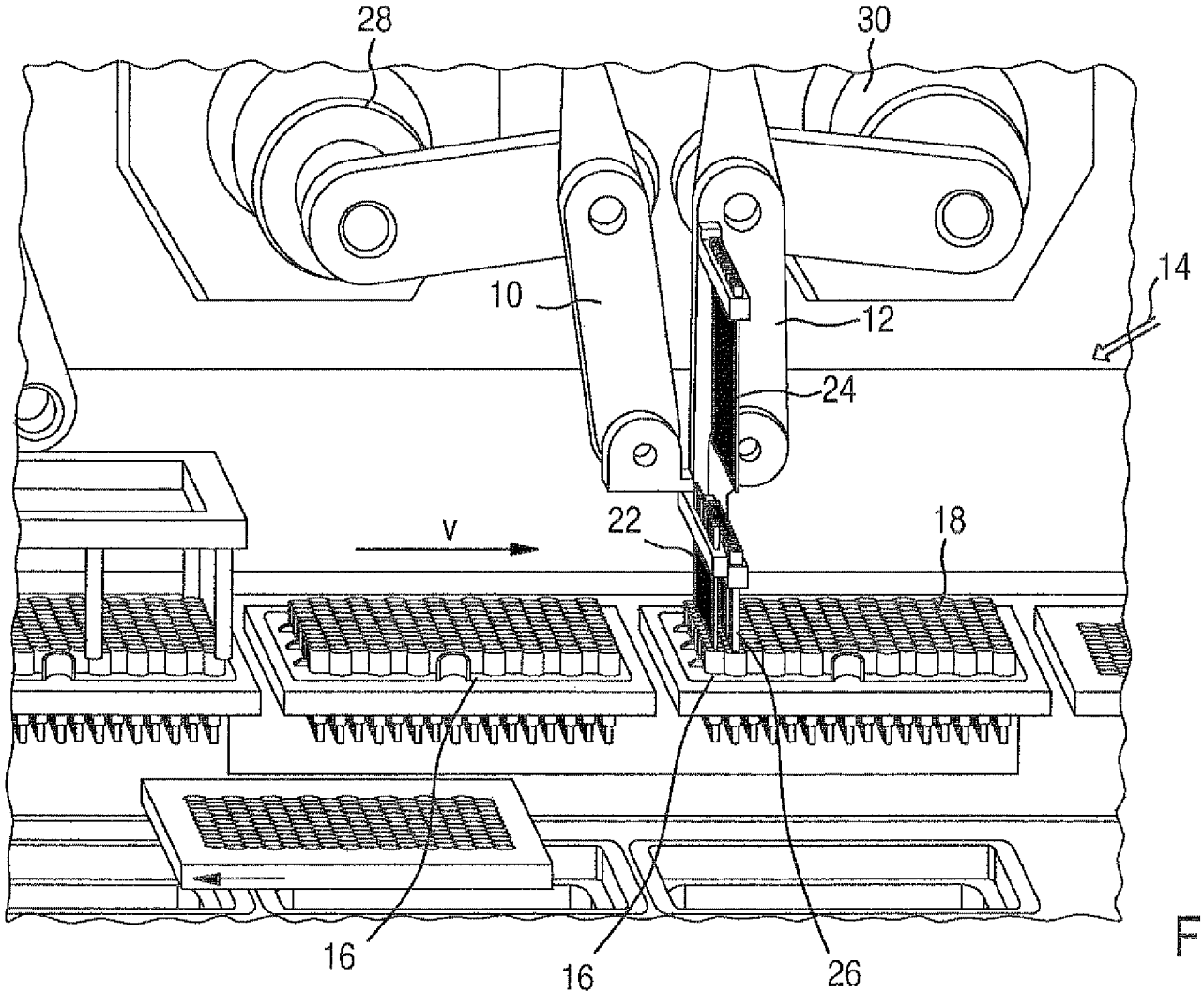
FIG. 1 is a perspective view of the container filling and sealing device according to the invention, in the "filling last row, sealing penultimate row" position.
Figure 2:
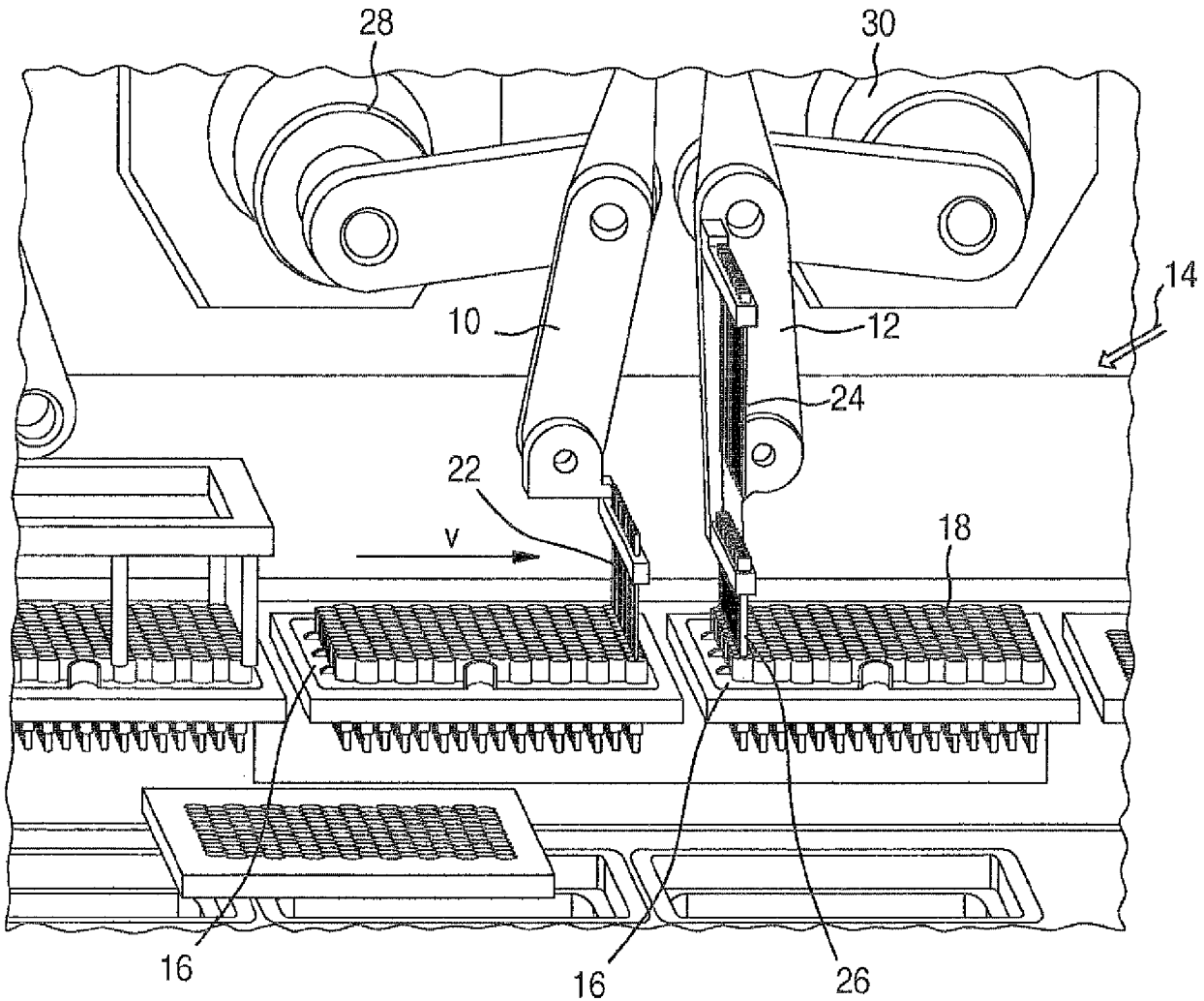
FIG. 2 shows the device according to FIG. 1 in the "filling first row, sealing last row" position.
Figure 3:
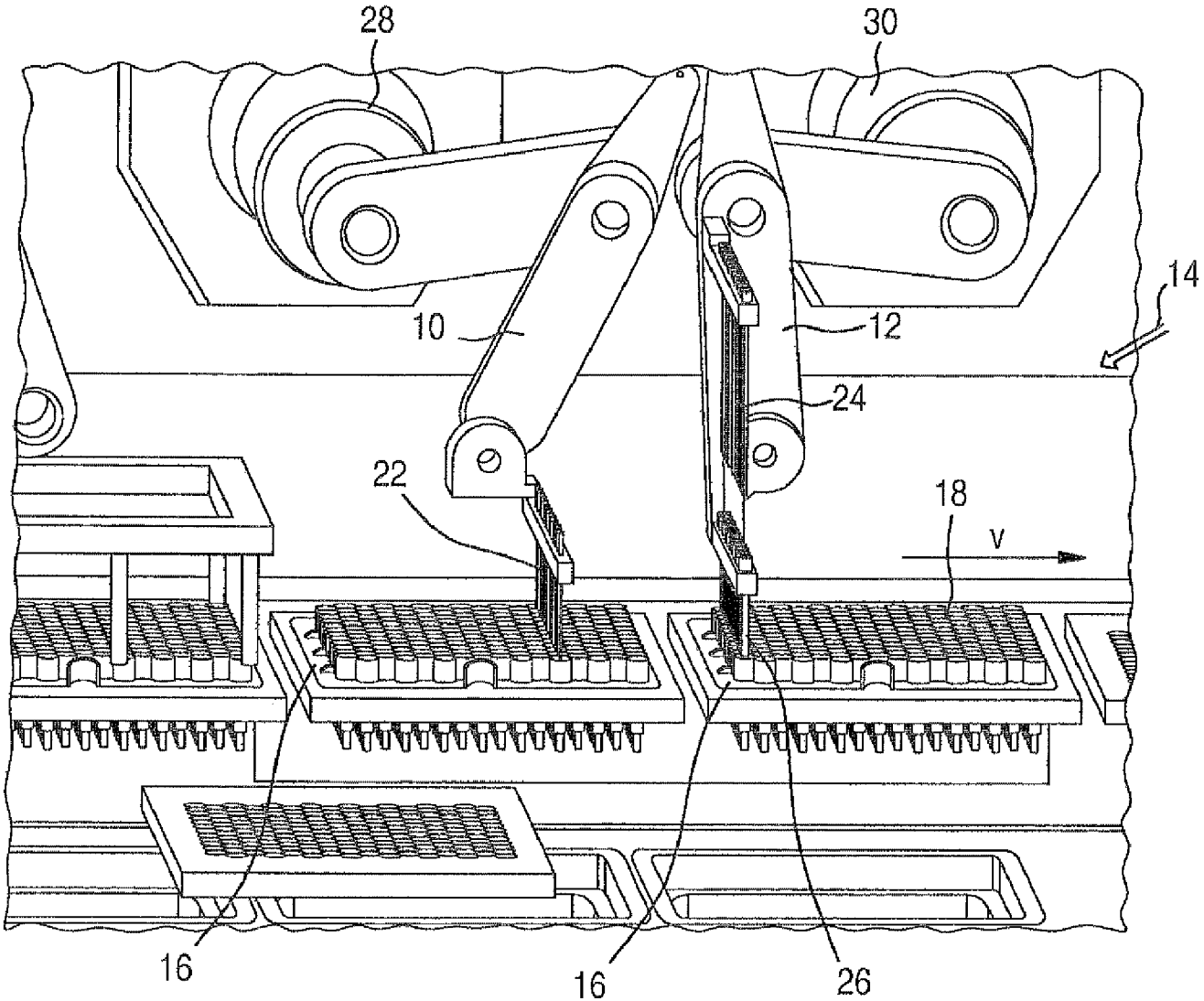
FIG. 3 shows the device according to the FIG. 1 in the "in-process control" position.

In the first exemplary embodiment according to the invention in FIGS. 1-3, a number of elongate nests 16 containing a plurality of containers 18 is shown. The nests 16 loaded with containers are transported in a transport direction (arrow V in FIG. 1) to various processing stations on a transport device 14. Each nest 16 has an elongate axis extending in the transport direction and a horizontal array of openings holding the plurality of containers 1 within the nest 16. The array of openings are arranged in adjacent rows extending transversely to the axis of the nest. The open containers are filled by a filling device 10 that supplies the containers with fluid via filling needles 22 arranged in a row. As shown in FIGS. 1-3, the row of filling needles extends transversely, to the axis of the nests and parallel to the adjacent rows of openings in the nests. A moving device 28 is able to move the filling device 10 at least in the transport direction of the transport device 14 and in the vertical direction. This makes it possible to achieve a variable distance between the filling needles 22 of the filling device 10 and a sealing device 12. The sealing device 12 is composed at least of insertion tubes 24 and rods 26 that are used to seal the filled containers 18. As shown in FIGS. 1-3, the row of insertion tubes and rods extends transversely to the axis of the nests and parallel to the adjacent rows of openings in the nests. In addition, another moving device 30 is provided, which enables a movement of the sealing device 12 likewise in the transport direction and in the vertical direction. This same device is also shown in FIGS. 2 and 3, albeit in different positions, as will be explained below. During the procedure, a centering device is placed under the respective nest 16 with the containers 18 in order to hold the containers 18 in a definite, stable position.

Figure 4:
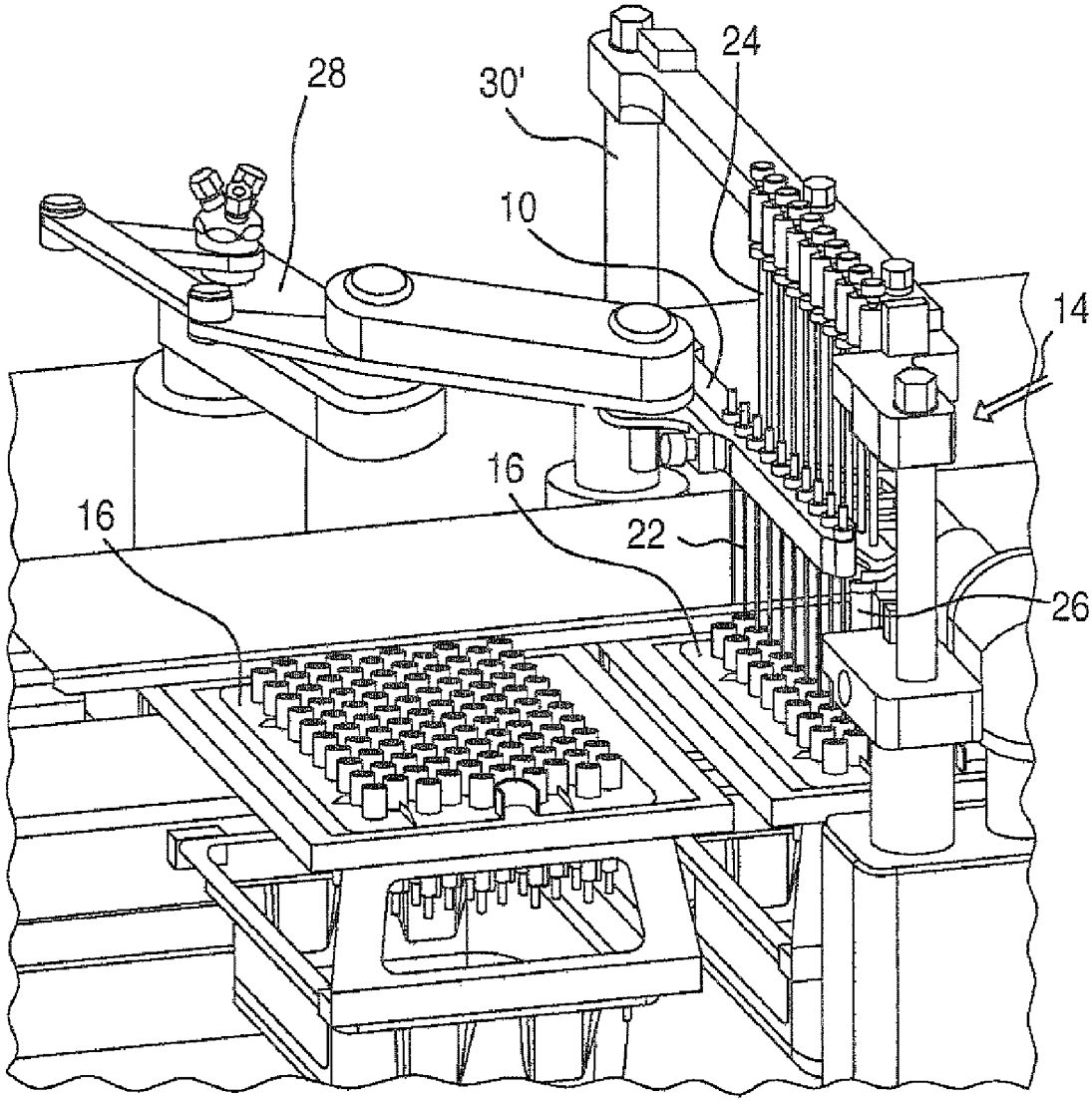
FIG. 4 shows a second exemplary embodiment of the device according to the invention.
Figure 5:
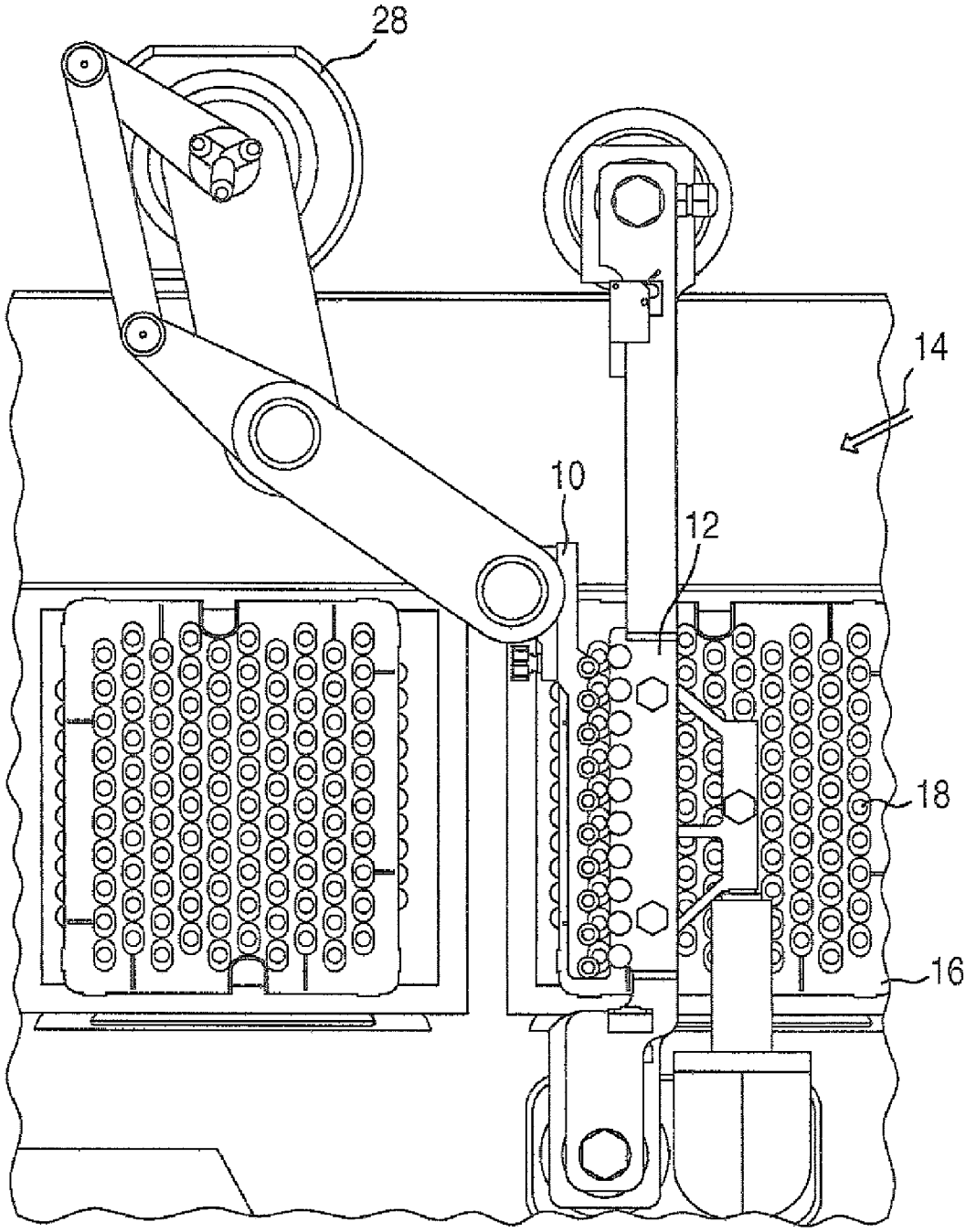
FIG. 5 is a top view of the device according to FIG. 4.

The second exemplary embodiment in FIGS. 4 and 5 differs from the preceding one in that the moving device 30' of the sealing device 12 permits only a movement in the vertical direction, but not in the transport direction. A corresponding linear guidance is shown in FIG. 4. A robot is used as the moving device 28 of the filling device 10 and moves the filling needles 22 in the transport direction, perpendicular to the transport direction, and in the vertical direction.

The first exemplary embodiment according to the invention operates as follows: the nests 16 holding the containers 18 are transported through one after another. Consequently, several nests 16 with containers 18 are arranged in series in centering devices. They are moved to the work stations one after another. Then a simultaneous filling and sealing occurs by means of the filling device 10 and the sealing device 12. According to the invention, the filling needles 22 can then also execute a movement in the transport direction. The transport device 14 executes a synchronized movement in order to always move the containers 18 precisely under the sealing device 12. The movement of the filling needles 22 of the filling device 10 can compensate for the offset between the nests 16. Thus, as shown in FIG. 1, the last row of the first nest 16 is filled and at the same time, the row immediately following is sealed by the sealing device 12. FIG. 2 shows the next work step. The filling device 10 then moves to the next nest 16 in order to fill the next row there. The transport device 14 moves one position further in order to seal the next row. Because the distance between the filling device 10 and the sealing device 12 is selected to be variable, the filling device 10 can already start the filling of the next nest 16, thus increasing the output. The moving device 30 produces the sealing motion with the insertion tube 24 and rod 26.

The variable position of the filling needles 22 allows them to also be used for filling containers 18 that are situated somewhat farther away in order to then subject them to an in-process control, as shown in FIG. 3. This can be necessary, for example, if the containers 18 must be removed for weighing after the filling and before the sealing. This is not possible with stations that are situated directly one after another. The above-described device is preferably suitable for a synchronized operation of the transport device 14. It could also, however, be used for a continuously running transport device.

The device shown in FIGS. 4 and 5 differs from the preceding one only with respect to the moving device 30' of the sealing device 12. In this instance, it does not permit a movement of the sealing device 12 in the transport direction. The nests 16 are moved as a function of the sealing position. The moving device 28 of the filling device 10 is embodied in the form of a robot, which, in addition to vertical and horizontal movements, can also execute movements in the transport direction. This makes it possible, in principle, to also reach the various operating positions shown in FIGS. 1 through 3.

The containers 18 to be filled can be syringes, for example.

The foregoing relates to a preferred exemplary embodiment of the invention, it being understood that other variants and embodiments thereof are possible within the spirit and scope of the invention, the latter being defined by the appended claims.

The invention claimed is:

1. A container filling and sealing device, the device comprising a filling device for filling at least one container, a sealing device for sealing at least one container, a transport device for supplying at least one container along a straight transport path to the filling device and sealing device, and a moving device for moving the filling device in a direction parallel to the transport path in order to vary the distance between the filling device and sealing device in the transport direction, wherein the transport device moves elongate nests along the transport path to the filling device and sealing device, the nests having an elongate axis extending in the direction of the transport path and an array of horizontally arranged openings for holding a plurality of containers, the array of openings comprising adjacent rows of openings extending transversely to the axis of the nests, the filling device comprises a row of filling needles extending transversely to the axis of the nests and parallel to the adjacent rows of openings in the nests, and the sealing device comprises a row of insertion tubes and rods extending transversely to the axis of the nests and parallel to the adjacent rows of openings in the nests.

2. The device as recited in claim 1, wherein the transport device is operated in a synchronized fashion.

3. The device as recited in claim 2, wherein the moving device is operable to move the filling device so that the filling device and the sealing device are able to fill and seal immediately adjacent rows of containers arranged in the nest.

4. The device as recited in claim 1, wherein the moving device is operable to move the filling device so that the filling device and the sealing device are able to fill and seal immediately adjacent rows of containers arranged in the nest.

5. The device as recited in claim 4, wherein the moving device is also operable to move the filling device in a direction perpendicular to the transport direction.

6. The device as recited in claim 4, wherein the moving device is operable to move the filling device relative to the sealing device so that the filling device fills a first row of a subsequent nest while the sealing device seals the last row of the preceding nest.

7. The device as recited in claim 4, wherein the moving device provides a sufficiently large distance between the filling device and the sealing device in order to supply filled containers to an in-process control.

8. The device as recited in claim 1, wherein the moving device is also operable to move the filling device in a direction perpendicular to the transport direction.

9. The device as recited in claim 1, wherein the moving device comprises a robot.

10. The device as recited in claim 1, wherein the moving device is operable to move the filling device relative to the sealing device so that the filling device fills a first row of a subsequent nest while the sealing device seals the last row of the preceding nest.

11. The device as recited in claim 1, wherein the moving device provides a sufficiently large distance between the filling device and the sealing device in order to supply filled containers to an in-process control.

12. A container filling and sealing device, the device comprising a filling device for filling at least one container, a sealing device for sealing at least one container, a transport device for supplying at least one container along a straight transport path to the filling device and sealing device, and a moving device for moving the filling device in a direction parallel to the transport path in order to vary the distance between the filling device and sealing device in the transport direction, wherein the transport device moves elongate nests along the transport path to the filling device and sealing device, the nests having an elongate axis extending in the direction of the transport path and an array of horizontally arranged openings for holding a plurality of containers, the array of openings comprising adjacent rows of openings extending transversely to the axis of the nests, the filling device comprises a row of filling needles extending transversely to the axis of the nests and parallel to the adjacent rows of openings in the nests, the sealing device comprises a row of insertion tubes and rods extending transversely to the axis of the nests and parallel to the adjacent rows of openings in the nests and the moving device is operable to move the filling device so that the filling device and the sealing device are able to simultaneously fill and seal immediately adjacent rows of containers arranged in the same nest.

13. A container filling and sealing device, the device comprising a filling device for filling at least one container, a sealing device for sealing at least one container, a transport device for supplying at least one container along a straight transport path to the filling device and sealing device, and a moving device for moving the filling device in a direction parallel to the transport path in order to vary the distance between the filling device and sealing device in the transport direction, wherein the transport device moves elongate nests along the transport path to the filling device and sealing device, the nests having an elongate axis extending in the direction of the transport path and an array of horizontally arranged openings for holding a plurality of containers, the array of openings comprising adjacent rows of openings extending transversely to the axis of the nests, the filling device comprises a row of filling needles extending transversely to the axis of the nests and parallel to the adjacent rows of openings in the nests, the sealing device comprises a row of insertion tubes and rods extending transversely to the axis of the nests and parallel to the adjacent rows of openings in the nests and the moving device is operable to move the filling device relative to the sealing device so that the filling device fills a first row of a subsequent nest while the sealing device simultaneously seals the last row of the preceding nest.

* * * * *